US005890766A

United States Patent [19]

Tsai

[11] Patent Number: 5,890,766

[45] Date of Patent: Apr. 6, 1999

[54] FOOT REST ASSEMBLY FOR CHAIRS

[76] Inventor: Chun Fa Tsai, No. 10, Lane 110, Ming Sheng St., Kuei-Jen Shiang, Tainan Shien, Taiwan

[21] Appl. No.: 905,353

[22] Filed: Aug. 4, 1997

[51] Int. Cl.[6] ..... A47C 7/50

[52] U.S. Cl. ..... 297/423.28; 297/423.3

[58] Field of Search ..... 297/423.26, 423.28, 297/423.3, 423.35

[56] References Cited

U.S. PATENT DOCUMENTS

| | | | |
|---|---|---|---|
| 4,389,070 | 6/1983 | Chien | 297/423.26 X |
| 4,819,987 | 4/1989 | Strunger | 297/423.35 |
| 5,358,266 | 10/1994 | Roth et al. | 297/423.35 X |
| 5,673,967 | 10/1997 | Wempe | 297/423.26 X |

FOREIGN PATENT DOCUMENTS

| | | | |
|---|---|---|---|
| 804978 | 11/1936 | France | 297/423.28 |
| 2049282 | 1/1980 | Germany | 297/423.28 |

*Primary Examiner*—Peter R Brown

*Attorney, Agent, or Firm*—Bacon & Thomas, PLLC

[57] ABSTRACT

A foot rest assembly for chairs includes a base frame secured to an underside of a chair and having a first positioning hole defined therein, a mounting member having a foot rest mounted thereon, a linking member, and a positioning member. The linking member includes a first end pivotally connected to the base frame and a second end pivotally connected to the mounting member, and a second positioning hole. A cable is extended through the positioning member and includes a first end secured to the mounting member and a second end. The positioning member further includes a positioning rod having a first end attached to the second end of the cable to move therewith and a second end extended through the first positioning hole.

5 Claims, 5 Drawing Sheets

FOOT REST ASSEMBLY FOR CHAIRS

BACKGROUND OF THE INVENTION

1. Field of the Invention

The present invention relates to a foot rest assembly for chairs.

2. Description of the Related Art

Some of the chairs are equipped with a foot rest to allow the user to lie down comfortably. Nevertheless, the foot rest is fixed to the chair and cannot be attached to currently available chairs as the foot rest has a complicated structure and is costly. Therefore, there has been a long and unfulfilled need for an improved foot rest assembly which mitigates and/or obviates the above problems.

SUMMARY OF THE INVENTION

It is an object of the present invention to provide an improved foot rest assembly which can be attached to currently available chairs so as to allow the user to lie down comfortably.

A foot rest assembly for chairs in accordance with the present invention comprises a base frame secured to an underside of a chair and having a first positioning hole defined therein, a mounting member having a foot rest mounted thereon, a linking member, and a positioning means. The linking member includes a first end pivotally connected to the base frame and a second end pivotally connected to the mounting member, and a second positioning hole. The positioning means includes a first end and a second end, and a cable is extended through the positioning means and includes a first end secured to the mounting member and a second end. The positioning means further includes a positioning rod having a first end attached to the second end of the cable to move therewith and a second end extended through the first positioning hole, and means is provided for biasing the second end of the positioning rod toward the first positioning hole.

When the mounting member is in a first position, the second end of the positioning rod is extended through the first positioning hole, and when the mounting member is in a second position, the second end of the positioning rod is extended through the first positioning hole and the second positioning hole to thereby retain the foot rest in position.

The mounting member may include means for restraining relative rotational movement between the mounting member and the linking member. Preferably, the base frame includes a side plate secured to the underside of the seat and a cylinder is interconnected between the side plate and the base frame, and wherein the positioning rod is extended through the cylinder.

A stud extends through the side plate and a sleeve is in threading connection with the stud to position the first an end of the positioning means.

In addition, the linking rod includes a fixing plate formed thereon, and a stud extends through the fixing plate and a sleeve is in threading connection with the stud to position the second end of the positioning means.

Other objects, advantages, and novel features of the invention will become more apparent from the following detailed description when taken in conjunction with the accompanying drawings.

DESCRIPTION OF THE PREFERRED EMBODIMENT

Figure 1:
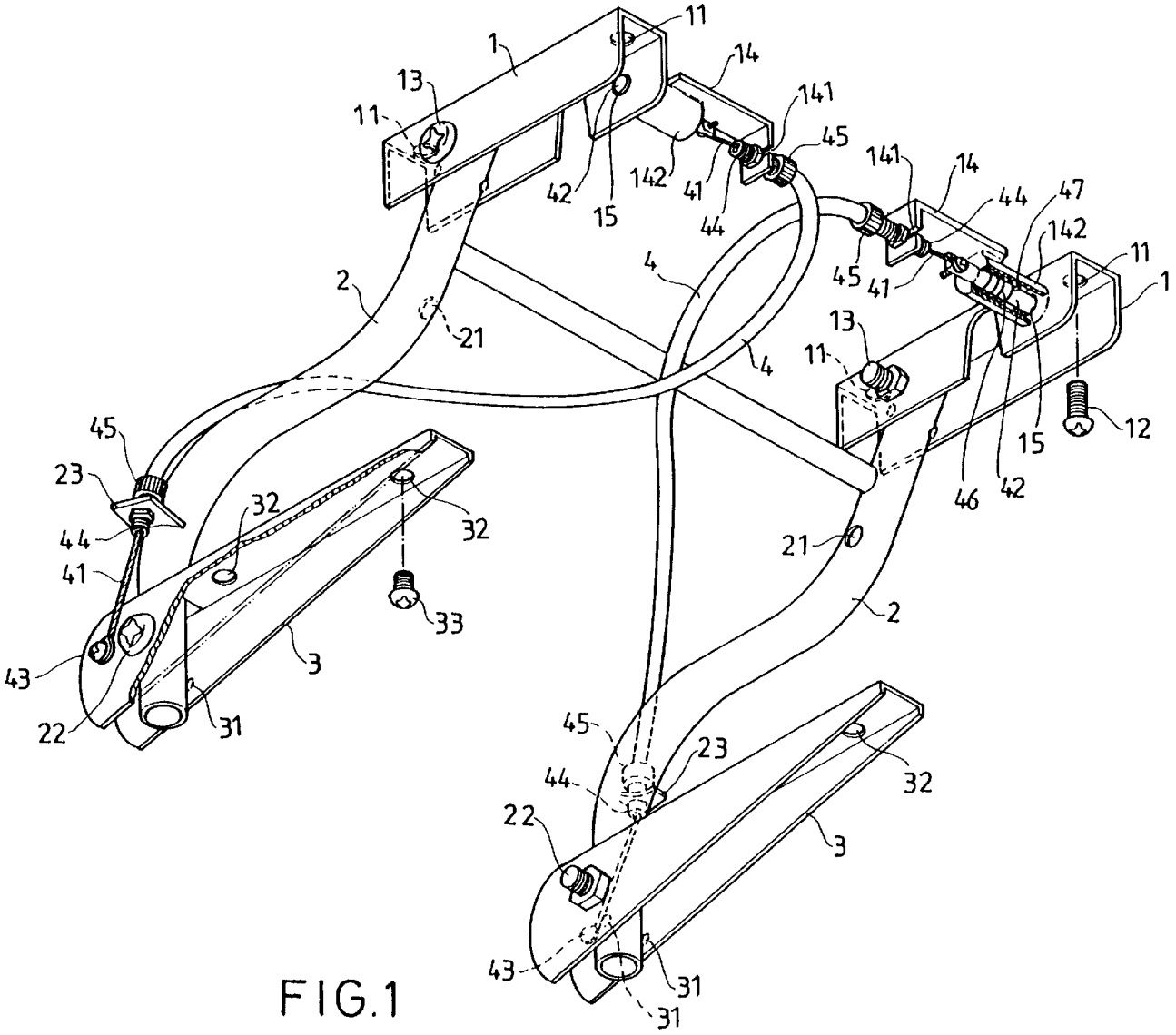
FIG. 1 is a perspective view of a foot rest assembly for chairs in accordance with the present invention.

Referring to the drawings and initially to FIG. 1, a foot rest assembly in accordance with the present invention generally two base frames 1 securely attached to an underside of a seat 6 (FIG. 2) of a chair, two linking members 2, two mounting members 3, and two positioning means 4. Each base frame 1 includes a number of holes 11 through which screws 12 are extended to secure the base frame 1 to the underside of the seat 6. Each base frame 1 further includes a side plate 14 and a positioning hole 15 defined therein. Each side plate 14 includes a notch 141 and a cylinder 142 is interconnected between the base frame 1 and the side plate 14. The cylinder 142 includes a bore which communicates with the positioning hole 15.

Each linking member 2 includes a first end pivotally connected to the associated base 1 at 13 and a second end pivotally connected to the associated mounting member 3 at 22. Each linking member 2 further includes a positioning hole 21 defined in a periphery thereof, which will be described later. Each linking member 2 further includes a fixing plate 23 formed on the periphery thereof for positioning an end of the associated positioning means 4.

Each mounting member 3 includes a number of holes 32 through which screws 33 extend so as to mount a foot rest 5 (FIG. 2) thereon. Each mounting member 3 further includes a stop member 31 to restrain pivotal movement between the mounting member 3 and the associated linking member 2.

Each positioning means 4 includes a cable 41 extending therethrough. An upper end of the positioning means 4 is positioned by a stud 44 which extends through the notch 141 and a sleeve 45 which is in threading connection with an outer threading of the stud 44, while a lower end of the positioning means 4 is positioned by a stud 44 which extends through the fixing plate 23 and a sleeve 45 which is in threading connection with an outer threading of the stud 44. In addition, a first end of the cable 41 is secured to the mounting member 3 at 43, while a second end of the cable 41 is secured to an end of a positioning rod 42 mounted in the cylinder 142. The other end of the positioning rod 42 is extended through the hole 15. In addition, an elastic member, e.g., a spring 46 is mounted in each cylinder 142 around the positioning rod 42 and includes a first end bearing against an end wall of the cylinder 142 and a second end bearing against a pin 47 on the positioning rod 42 to thereby bias the positioning rod 42 to engage with the positioning hole 15 and the positioning hole 21 (if the positioning hole 21 aligns with the positioning hole 15).

Figure 2:
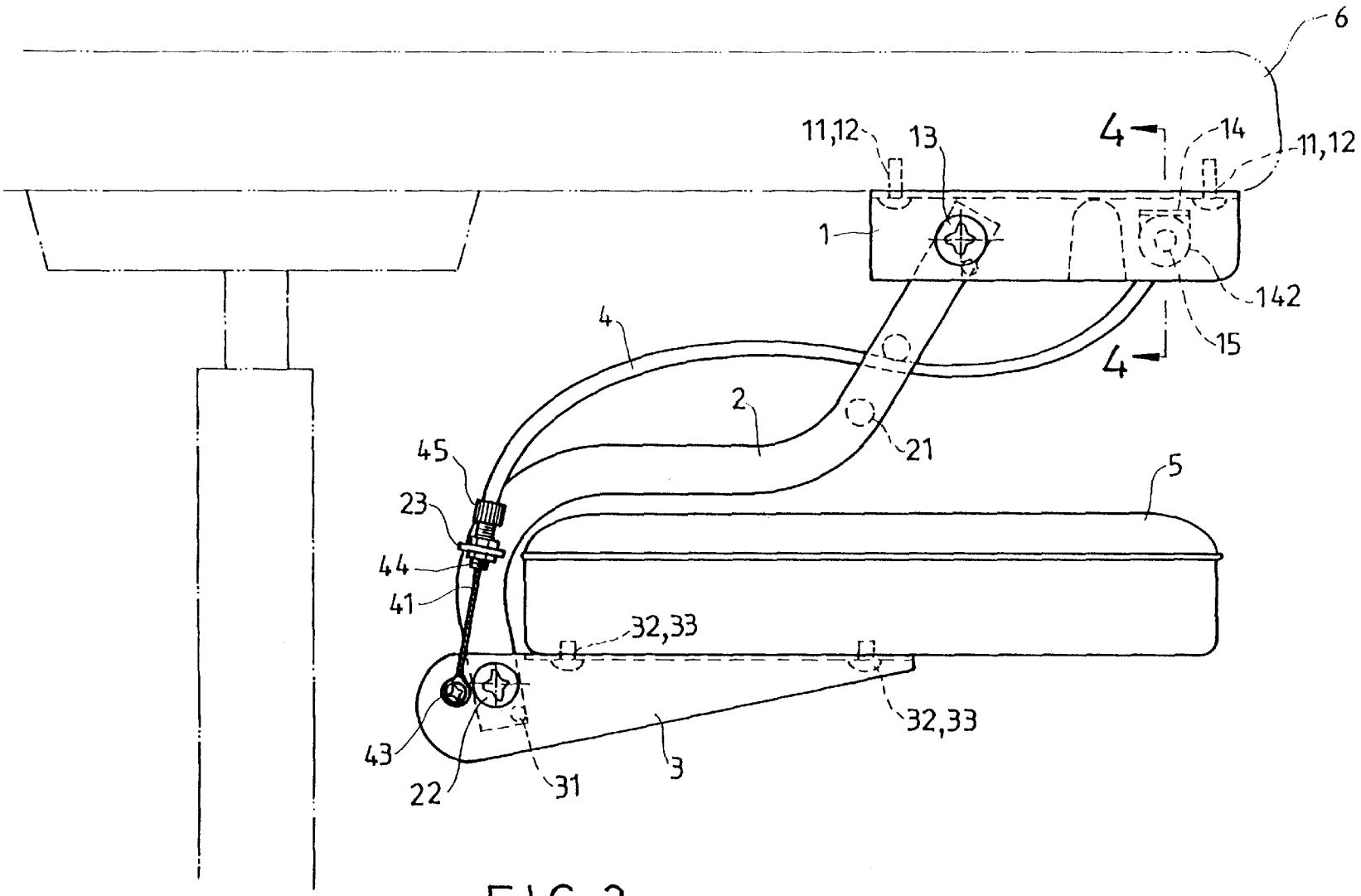
FIG. 2 is a side view of the foot rest assembly of the present invention, in which the chair is illustrated in phantom lines for clarity.
Figure 3:
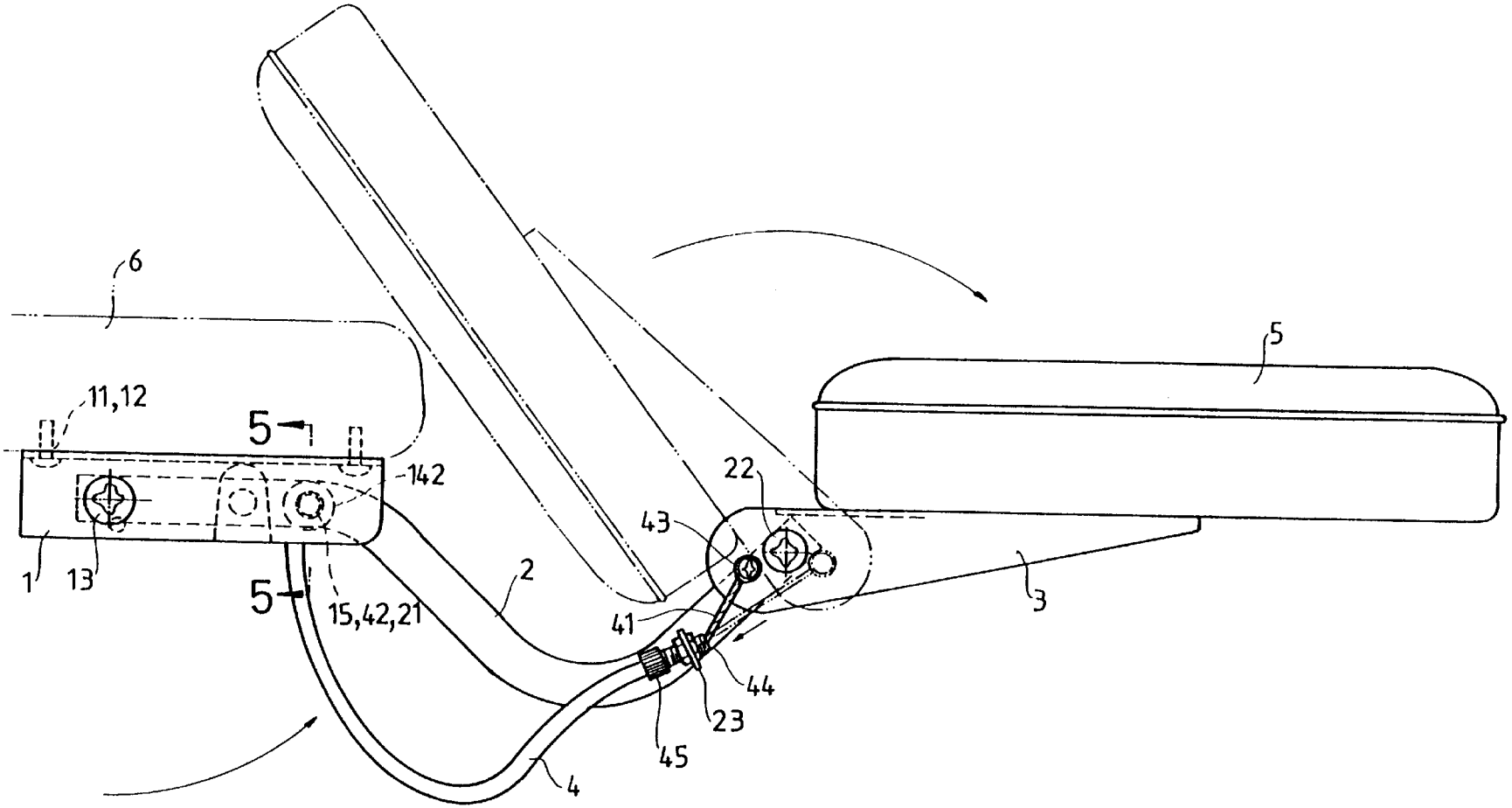
FIG. 3 is a side view of the foot rest assembly of the present invention, in which the foot rest assembly is in an extended status.
Figure 4:
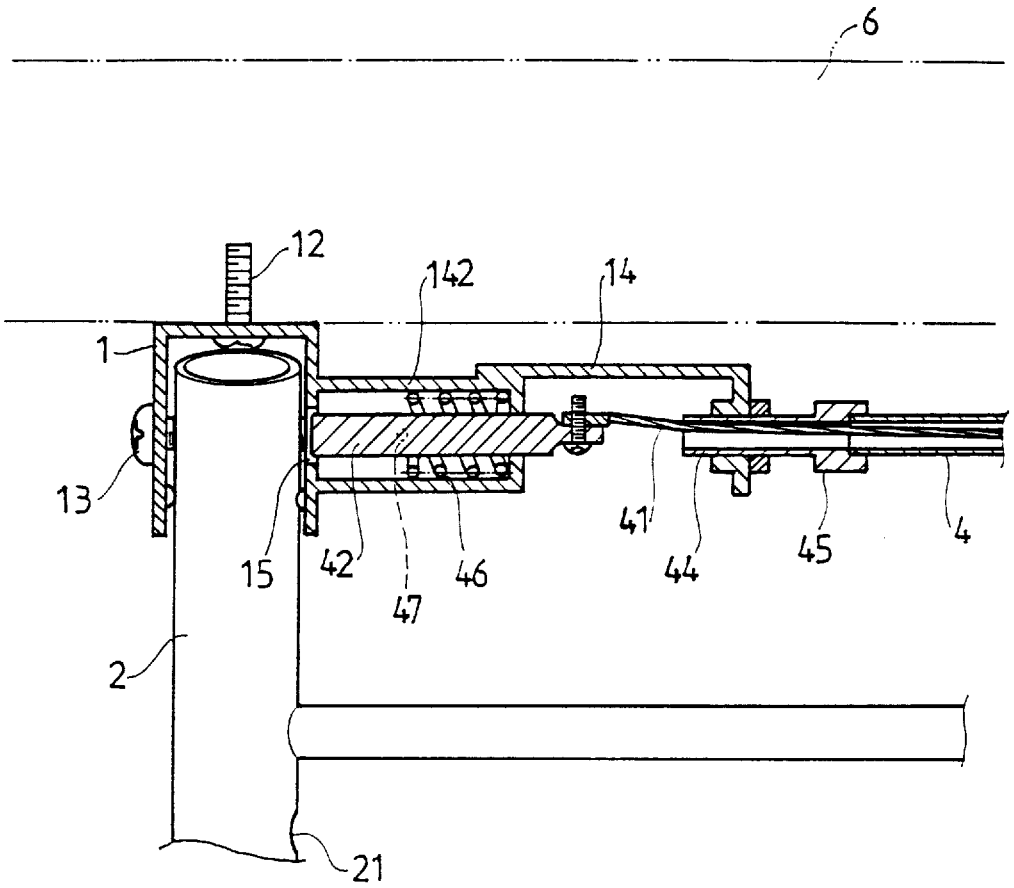
FIG. 4 is a cross sectional view taken along line 4—4 in FIG. 2.
Figure 5:
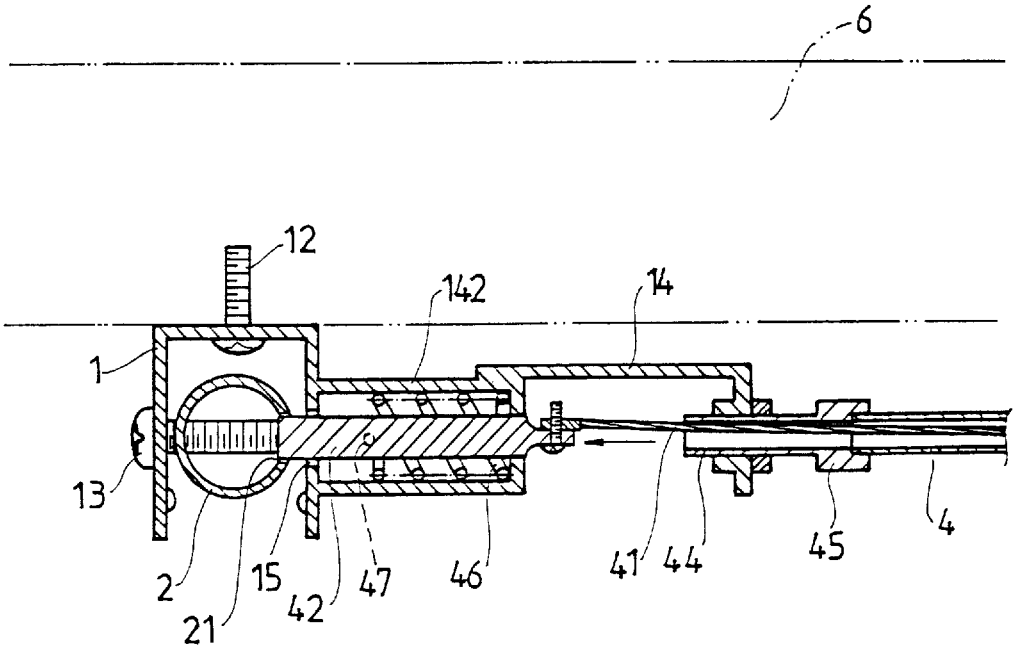
FIG. 5 is a cross sectional view taken along line 5—5 in FIG. 3.
Figure 6:
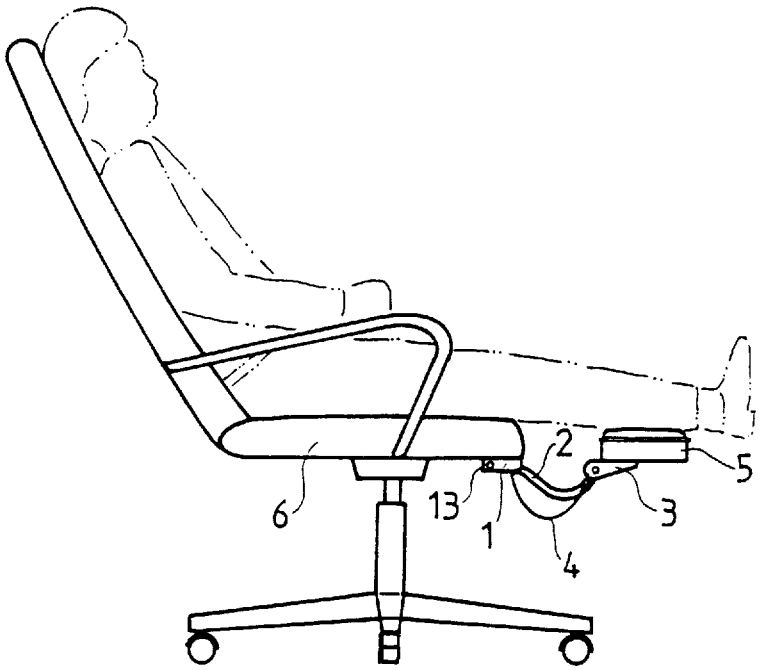
FIG. 6 is a schematic side view illustrating usage of the foot rest assembly.

Referring to FIG. 2, in assembly, the base frames 1 are secured to the underside of the seat 6, and the foot rest 5 is secured to the mounting members 3. The foot rest assembly in FIG. 2 is in a storage position. In use, referring to FIG. 3, the mounting members 3 are pulled outwardly and then pivoted until the foot rest 5 is at the same level as or lower than the seat 6. It is appreciated that a distance between the fixing point 43 of the cable 41 and the positioning head 44 becomes shorter such that the cable 41 is pulled by the spring 46, and the positioning rod 42 is extended into the positioning hole 21, as shown in FIG. 5, thereby retaining the positioning rod 2 in position (cf. FIG. 4). Accordingly, the linking rods 2 are positioned such that the foot rest 5 is retained at the same level, thereby allowing the user to lie down comfortably, as shown in FIG. 6.

It is appreciated that the foot rest assembly may include only one base frame 1, one linking member 2, one mounting member 3, and one positioning means 4 without departing from the scope of the invention.

Although the invention has been explained in relation to its preferred embodiment, it is to be understood that many other possible modifications and variations can be made without departing from the spirit and scope of the invention as hereinafter claimed.

What is claimed is:

1. A foot rest assembly for chairs, comprising:

a base frame adapted to be secured to an underside of a chair, the base frame including a first positioning hole defined therein, a mounting member having a foot rest mounted thereon, a linking member including a first end pivotally connected to the base frame, a second end pivotally connected to the mounting member, and a second positioning hole, a positioning means including a first end and a second end, a cable being extended through the positioning means and including a first end secured to the mounting member and a second end, the positioning means further including a positioning rod, having a first end attached to the second end of the cable to move therewith and a second end extended through the first positioning hole, and means for biasing the second end of the positioning rod toward the first positioning hole, whereby when the mounting member is in a first position, the second end of the positioning rod is extended through the first positioning hole, and when the mounting member is in a second position, the second end of the positioning rod is extended through the first positioning hole and the second positioning hole to thereby retain the foot rest in position.

2. The foot rest assembly according to claim 1, wherein the mounting member further includes means for restraining relative rotational movement between the mounting member and the linking member.

3. The foot rest assembly according to claim 1, wherein the base frame includes a side plate secured to the underside of the seat and a cylinder is interconnected between the side plate and the base frame, and wherein the positioning rod is extended through the cylinder.

4. The foot rest assembly according to claim 3, further including a stud which extends through the side plate and a sleeve which is in threading connection with the stud to position the first end of the positioning means.

5. The foot rest assembly according to claim 1, wherein the linking rod includes a fixing plate formed thereon, and further includes a stud which extends through the fixing plate and a sleeve which is in threading connection with the stud to position the second end of the positioning means.

* * * * *